US008978933B2

(12) United States Patent
Muller et al.

(10) Patent No.: US 8,978,933 B2
(45) Date of Patent: Mar. 17, 2015

(54) FLUID PRODUCT DISTRIBUTOR

(75) Inventors: Patrick Muller, Saint Aubin sur Gaillon (FR); Bruno Stuart, Hauville (FR)

(73) Assignee: Aptar France SAS, Le Neubourg (FR)

( * ) Notice: Subject to any disclaimer, the term of this patent is extended or adjusted under 35 U.S.C. 154(b) by 46 days.

(21) Appl. No.: 13/984,739

(22) PCT Filed: Feb. 20, 2012

(86) PCT No.: PCT/FR2012/050359
§ 371 (c)(1),
(2), (4) Date: Aug. 9, 2013

(87) PCT Pub. No.: WO2012/114034
PCT Pub. Date: Aug. 30, 2012

(65) Prior Publication Data

US 2013/0306681 A1 Nov. 21, 2013

(30) Foreign Application Priority Data

Feb. 23, 2011 (FR) ..... 11 51470

(51) Int. Cl.
*B67D 7/22* (2010.01)
*B67B 1/00* (2006.01)
(Continued)

(52) U.S. Cl.
CPC ..... *B05B 11/0097* (2013.01); *B05B 11/0016* (2013.01); *B05B 11/0051* (2013.01);
(Continued)

(58) Field of Classification Search
USPC ..... 222/321.1, 321.9, 183, 51, 153.04, 222/153.13, 153.14; 141/18, 113, 95, 192, 141/198, 212, 229
See application file for complete search history.

(56) References Cited

U.S. PATENT DOCUMENTS 7,997,451 B2 * 8/2011 Carnacina ..... 222/153.11
8,662,116 B2 * 3/2014 Dumont et al. ..... 141/113
(Continued)

FOREIGN PATENT DOCUMENTS

EP 1896189 B1 * 11/2008
FR 2 819 793 A1 7/2002

OTHER PUBLICATIONS

EP 1896189 B1—English Translation—Machine Generated, Nov. 2014.*
English translation of the International Preliminary Report on Patentability for PCT/FR2012/050359.
International Search Report for PCT/FR2012/050359, dated Jun. 4, 2012.

*Primary Examiner* — J. Casimer Jacyna
*Assistant Examiner* — Benjamin R Shaw
(74) *Attorney, Agent, or Firm* — Sughrue Mion, PLLC

(57) ABSTRACT

A fluid dispenser comprising:
a fluid reservoir (1) defining a neck (11) and a bottom wall (12) provided with a filling valve (13, 15);
a dispenser member (5), such as a pump, that is mounted on the reservoir (1) so as to take the fluid, the dispenser member (5) including a body (51) and an actuator rod (56) that is movable downwards and upwards along an axis X;
a pusher (6, 7) that is mounted on the actuator rod (56) of the dispenser member (5) in such a manner as to turn about the axis X of the rod (56);
a vent passage that puts the reservoir (1) into communication with the outside;
closure means (3) for selectively closing the vent passage; and
control means (4) for urging the closure means (3) into a closed condition, in which they close the vent passage, from an open condition, in which they do not close the vent passage;
the dispenser being characterized in that the control means (4) are secured to the pusher (6, 7) or moved by the pusher.

15 Claims, 3 Drawing Sheets

(51) Int. Cl.

| | |
|---|---|
| ***B67D 7/06*** | (2010.01) |
| ***B65D 88/54*** | (2006.01) |
| ***G01F 11/00*** | (2006.01) |
| ***B67C 3/02*** | (2006.01) |
| ***B05B 11/00*** | (2006.01) |

(52) U.S. Cl.

CPC ..... *B05B11/0056* (2013.01); *B05B 11/30* (2013.01); *B05B 11/3059* (2013.01); *B05B 11/3047* (2013.01); *B05B 11/3052* (2013.01)

USPC ..... 222/321.9; 222/183; 222/51; 222/153.13; 141/113

(56) References Cited

U.S. PATENT DOCUMENTS

| | | | | |
|---|---|---|---|---|
| 8,695,896 | B2 * | 4/2014 | Tu | 239/333 |
| 8,783,523 | B2 * | 7/2014 | Dumont et al. | 222/321.9 |
| 2005/0109794 | A1 * | 5/2005 | Murakami et al. | 222/51 |
| 2012/0312843 | A1 * | 12/2012 | Dumont et al. | 222/321.9 |
| 2013/0019991 | A1 * | 1/2013 | Muller | 141/18 |
| 2013/0019992 | A1 * | 1/2013 | Feriani et al. | 141/18 |
| 2013/0068796 | A1 * | 3/2013 | Hui et al. | 222/256 |

* cited by examiner

FLUID PRODUCT DISTRIBUTOR

CROSS REFERENCE TO RELATED APPLICATIONS

This application is a National Stage of International Application No. PCT/FR2012/050359 filed Feb. 20, 2012, claiming priority based on French Patent Application No. 11 51470 filed Feb. 23, 2011, the contents of all of which are incorporated herein by reference in their entirety.

The present invention relates to a fluid dispenser comprising a fluid reservoir on which there is mounted a dispenser member such as a pump. The dispenser member comprises a body and an actuator rod on which there is mounted a pusher that the user may depress by means of one or more fingers. Advantageous fields of application of the present invention are the fields of perfumery, cosmetics, and pharmacy.

In the prior art, refillable fluid dispensers are already known having a reservoir that includes a filling valve. In addition, the dispenser forms a vent passage that puts the reservoir into communication with the outside. The vent passage may be closed by means of closure means that are urged by means of control means. The closure means may thus be brought into a closed condition, in which they close the vent passage, from an open or vent condition, in which the reservoir communicates with the outside through the vent passage. By way of example, document EP 1 896 189 is known which describes a refillable fluid dispenser having a reservoir that includes a bottom wall that is provided with a filling valve. In addition, a vent passage is formed either through the dispenser member or through a hole that is formed in the reservoir and that is closable by means of a valve that may be moved by means of a slidable control. In both embodiments, it is difficult to open or close the vent passage. In both embodiments, it is necessary to perform a specific operation that is not very conventional and that users are not used to doing. As a result, the user must study the instructions for the dispenser beforehand, in order to understand how it is possible to open the vent passage, so as to enable the air in the reservoir to escape while filling with fluid through the filling valve. In general, users are unwilling to use any operating mode that is unconventional or not intuitive.

An object of the present invention is to remedy the abovementioned drawbacks of the prior art by defining an operating mode that is particularly simple for causing the control means to urge the closure means to close the vent passage. Another object of the present invention is to reduce the number of component parts of the fluid dispenser to as few as possible. Still another object of the present invention is to make a dispenser that can be mounted or assembled in extremely simple and achievable manner by means of machines that are not very sophisticated.

To achieve these objects, the present invention defines a fluid dispenser comprising: a fluid reservoir defining a neck and a bottom wall provided with a filling valve; a dispenser member, such as a pump, that is mounted on the reservoir so as to take the fluid, the dispenser member including a body and an actuator rod that is movable downwards and upwards along an axis X; a pusher that is mounted on the actuator rod of the dispenser member in such a manner as to turn about the axis X of the rod; a vent passage that puts the reservoir into communication with the outside; closure means for selectively closing the vent passage; and control means for urging the closure means into a closed condition, in which they close the vent passage, from an open condition, in which they do not close the vent passage; the dispenser being characterized in that the control means are turned by the pusher so as to switch the closure means between their open condition and their closed condition. Thus, by turning the pusher about its own axis, the user unconsciously opens or closes the vent passage.

It is even possible to envisage that the control means are incorporated in the pusher, in such a manner that they cannot be separated therefrom. Thus, the operating mode of the control means is extremely limited, since it is imposed directly by the kinds of movement that the pusher can perform, namely axially along the axis X and/or in turning about the same axis X. Either way, such movements are well known and are extremely widespread.

In an advantageous embodiment, the control means are in engagement with a cam path that defines two offset axial positions for moving the control means axially between the closed and open conditions. Preferably, the cam path is formed by a bushing that is secured to the reservoir. Thus, by turning the pusher about its own axis, the control means follow the cam path so as to move it axially and thus release or engage the vent passage closure means.

In a practical embodiment, the device includes fastener means for fastening the dispenser member in the reservoir, the fastener means comprising a fastener ring in leaktight engagement in the neck of the reservoir, and reception means for receiving the body of the dispenser member, the fastener ring being connected to the reception means via an annular disk. Advantageously, the bushing is formed by the fastener means, advantageously in axial alignment with the fastener ring.

Advantageously, the vent passage comprises a vent hole that is formed in the fastener means, advantageously at the annular disk. In a practical embodiment, the closure means comprise an annular gasket that is arranged on the annular disk in such a manner as to be able to be compressed between the control means and the fastener means. Thus, the control means are constrained to turn with the pusher, but may move axially relative to the pusher in such a manner as to be able to follow the cam path so as to move it axially. The axial movement of the control means makes it possible to compress or release the annular gasket that acts as closure means over the vent hole that is formed at the annular disk of the fastener means.

In another advantageous aspect of the present invention, the reception means comprise a tube in which the body of the dispenser member is interfitted in leaktight manner. Advantageously, the tube extends into the proximity of the bottom wall of the reservoir, a gauge ring being engaged freely around the tube in such a manner as to float in guided manner in the fluid of the reservoir so as to indicate the level of fluid in the reservoir. In addition or in a variant, the tube extends into the proximity of the bottom wall of the reservoir, the dispenser member being provided with a dip tube that extends into the reservoir, the tube surrounding the dip tube so as to guide it into the reservoir and/or hold it therein, in particular at the bottom of the reservoir. The dip tube usually presents a slight curve that deflects it from the axis of the reservoir and that could prevent or hinder proper operation of the bottom filling valve. By holding it in this way substantially on the axis, it is possible to avoid any interference with the filling valve. In addition or in a variant, the tube extends into the proximity of the bottom wall of the reservoir, the filling valve comprising a valve seat formed in the bottom wall of the reservoir and a valve member received in the reservoir and further comprising a closure pin for selectively coming into leaktight contact with the valve seat, the pin being connected to resilient drive elements, the tube pressing on the resilient elements so as to urge the pin against its seat. Thus, the tube is used to perform several functions, namely receiving the pump body, guiding the gauge ring, holding the dip tube stationary, and pre-stressing the pin of the filling valve.

In another very advantageous aspect of the present invention, the device further includes a locking system for locking the pusher, preventing it from moving axially in a locked position and allowing it to move axially in an actuation position, the pusher switching from one position to the other by turning about the axis X. Advantageously, the locking system is formed by the pusher and the bushing. In the prior art, pusher locking systems are already known that function by turning the pusher about the axis X. By way of example, document FR 2 819 793 may be mentioned. Thus, without even realizing it, the user closes and opens the vent passage, while being aware only of locking or unlocking the pusher of the dispenser. The vent passage is thus opened or closed without it being necessary to implement a particular and/or additional operating mode. It suffices to inform the user that the reservoir can be filled only when the pusher is in its unlocked position, without the user ever needing to know that the dispenser incorporates a vent passage, closure means, and control means.

The spirit of the invention resides in making operation of the vent passage closure control means depend on moving the pusher in conventional manner, namely axially and/or in turning about its own axis. Turning about its own axis is advantageous since that may be associated with a locking system for locking the pusher.

The invention is described more fully below with reference to the accompanying drawings, which shows an embodiment of the invention by way of non-limiting example.

Figure 1:
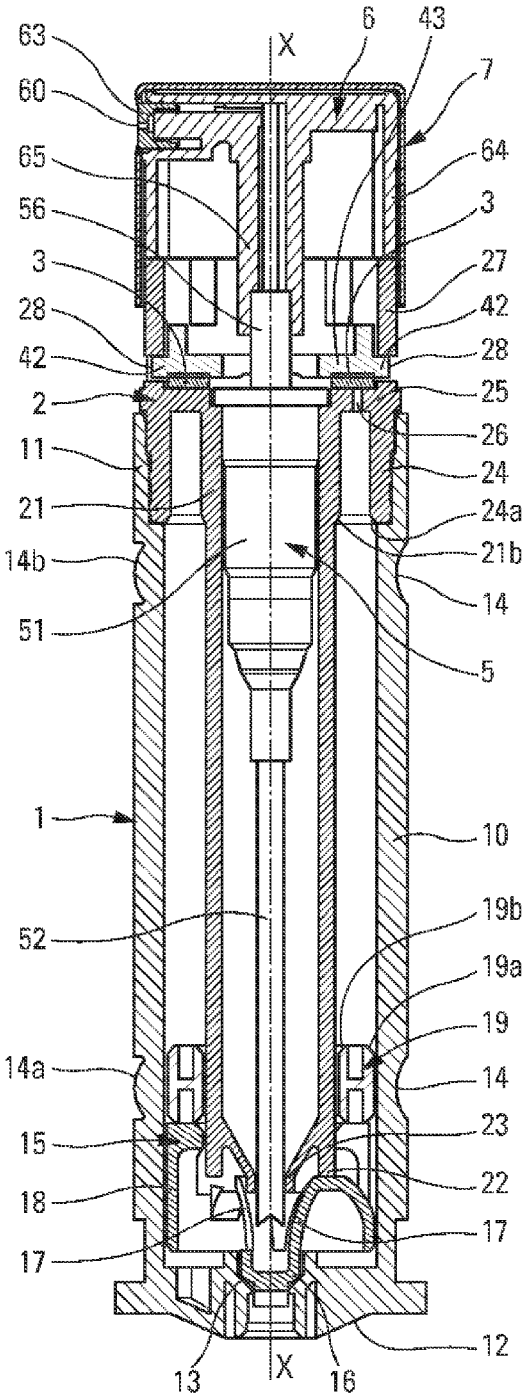
FIG. 1 is a vertical section view through a dispenser made in accordance with the invention.

Reference is made to FIGS. 1 to 4 taken together in order to describe in detail the structure and the operation of a fluid dispenser made in accordance with a non-limiting embodiment of the invention.

The dispenser includes a fluid reservoir 1 forming a cylinder 10 that is substantially cylindrical, which cylinder is closed at its bottom end by a bottom wall 12 that defines a valve seat 13. At its opposite end, the cylinder 10 defines an opening in the form of a neck 11 that internally forms fastener profiles. The cylinder 10 includes four viewing windows 14, 14*a*, 14*b* through which it is possible to see the inside of the reservoir. By way of example, it is possible to provide two top windows and two bottom windows. One of the top windows 14*b* may be provided with a magnifying lens, just like one of the bottom windows 14*a*. Instead of the windows, provision may also be made for all or part of the cylinder 10 to be transparent. It is also possible to imagine one or more vertical windows that extend over all or part of the height of the cylinder 10. The essential point is that the user can see the inside of the reservoir, at least at its bottom portion and at its top portion that correspond to the empty and full configurations of the reservoir.

The reservoir 1 also includes a valve member 15 that is arranged in the reservoir in the proximity of the bottom wall 12. The valve member 15 includes a valve pin 16 for selectively coming into leaktight contact with the seat 13 of the bottom wall 12, there forming a filling valve. The pin 16 is urged by resilient tabs or blades 17 that join a mounting collar 18 that is engaged inside the reservoir. By way of example, provision may be made for the tabs 17 to be stressed a little so that the pin 16 also bears against its seat 13. The valve is opened by pushing the pin 16 out of contact with the seat 13 by stressing the resilient tabs 17.

The dispenser also includes fastener means 2 making it possible to fasten a dispenser member 5 in stable and leaktight manner in the neck 11 of the reservoir 1. The fastener means 2 comprise a fastener ring 24 in leaktight engagement in the neck 11, an annular disk 25 that extends inwards from the top end of the fastener ring 24, and a tube 21 that extends downwards from the inner periphery of the disk 25 inside the fastener ring 24. The tube 21 is substantially cylindrical and extends into the proximity of the bottom wall 12. It should be observed that the bottom edge 22 of the tube 21 comes into contact with the resilient tabs 17, so as to pre-stress them in such a manner as to press the pin 16 against the seat 13. Thus, the tube 21 performs a first function of pressing and pre-stressing the resilient tabs 17. It should also be observed that the tube 21 is surrounded by a gauge ring 19 that is movable freely along the tube 21. Thus, the dip tube 21 performs an axial guide function for the gauge ring 19. The gauge ring 19 is made of a material that is less dense than the fluid contained in the reservoir, such that it floats to the surface of the fluid. Thus, the gauge ring 19 gives a direct visual indication of the fluid level inside the reservoir. In the position shown in FIG. 1, the reservoir is substantially empty and the gauge ring 19 rests on the mounting collar 18 of the valve member 15. The gauge ring 19 is thus visible through the window 14*a*. When the reservoir is full, the gauge ring 19 is situated in the proximity of the top window 14*b* and may be observed by the user. Advantageously, the gauge ring 19 includes two coaxial sealing edges 19*a*, 19*b* for coming into leaktight contact with two annular sealing seats 21*b* and 24*a* respectively formed on the tube 21 and on the fastener ring 24. Leaktight contact is established when the reservoir is full and when the ring 19 is visible through the window 14*b*.

In the invention, a vent passage 26 is formed through the disk 25 and puts the inside of the reservoir 1 into communication with the outside. Thus, when fluid is injected into the reservoir through the filling valve (formed by the seat 13 and the pin 16), the air initially present in the reservoir can escape through the vent hole 26. The reservoir is filled until the gauge 19 comes into leaktight contact with the seats 21*b* and 24*a*: the reservoir is thus completely full. In a variant, when the gauge ring 19 does not provide sealing with the fastener means 2, filling takes place until the fluid reaches the vent hole 26. The way in which the vent hole 26 is closed so as to avoid any leakage is described below.

As mentioned above, the tube 21 serves as reception means for receiving a dispenser member 5 that may be a pump or a valve. More precisely, the dispenser member 5 includes a body 51 that is interfitted in stationary and leaktight manner in the tube 21. The dispenser member 5 also includes an actuator rod 56 that is movable downwards and upwards along a vertical axis X. Thus, by driving the rod 56 into the body 51, fluid is driven, in optionally-metered manner, through the actuator rod 56. This design is entirely conventional for a pump or a valve in the fields of perfumery, cosmetics, and even pharmacy. It should be observed that the dispenser member 5 also includes a dip tube 52 that extends inside the tube 21 into the proximity of the bottom wall 12. The dip tube 52 is held or guided in completely axial manner and is held stationary by a small holding lip 23 that is formed at the bottom end of a small cone that extends downwards in the tube 21. Thus, the dip tube 52 is guided into the cone so as to pass finally through the holding lip. Consequently, the tube 21 also performs a holding function for holding the dip tube, thereby preventing it from disturbing proper operation of the filling valve.

By masking the often unattractive dip tube 52, the tube 21 performs a decorative function or it may support decoration. Scale marks may also be made thereon so as to make it easier to read the fluid level in the reservoir.

Figure 3:
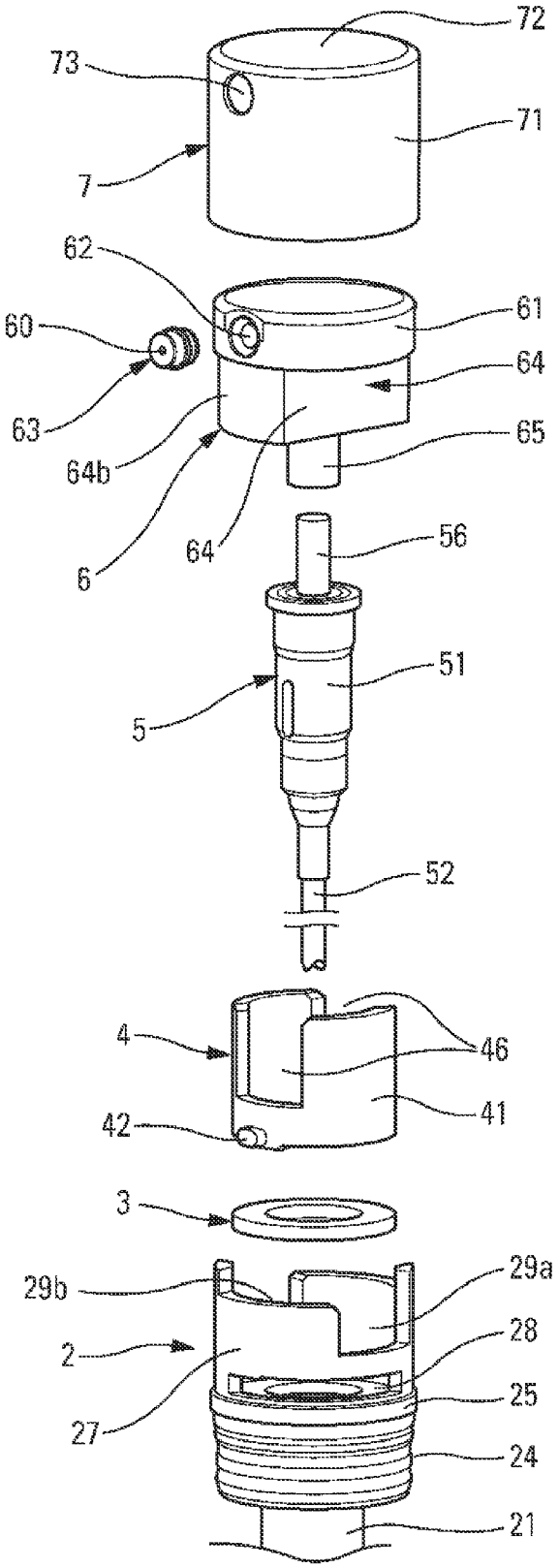
FIG. 3 is an exploded perspective view of the top portion of the dispenser in FIGS. 1 and 2.
Figure 4:
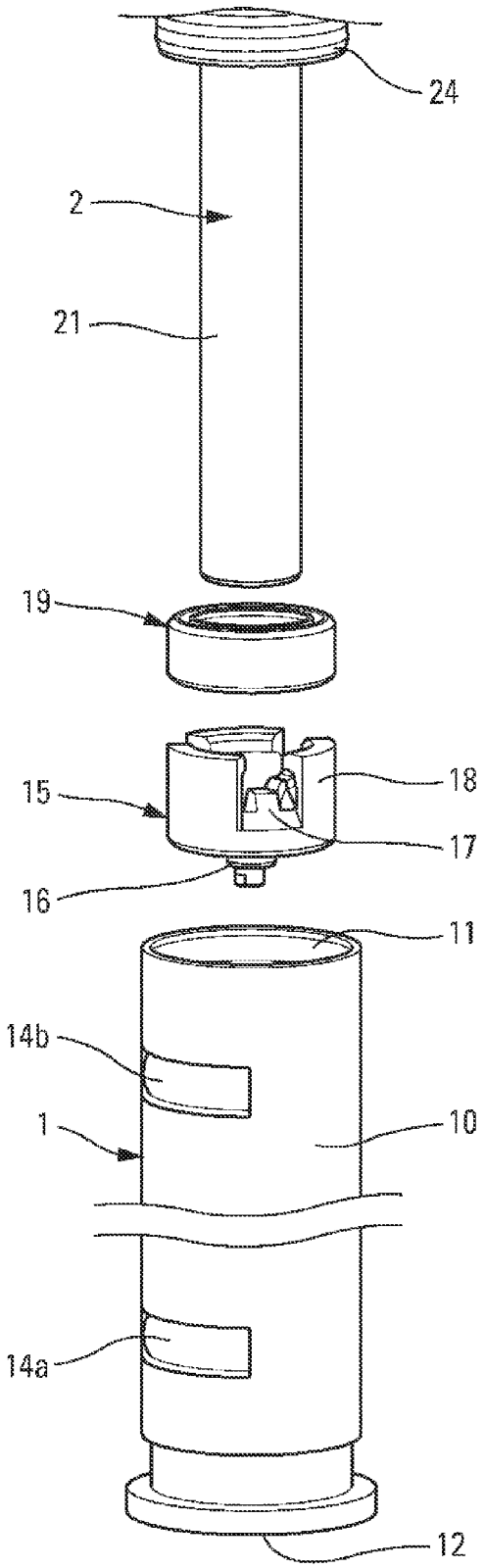
FIG. 4 is a view similar to the view in FIG. 3 for the bottom portion of the dispenser.

The dispenser of the invention also includes a pusher comprising a core 6 and an outer casing 7. The core 6 may be made by injection-molding plastics material, whereas the casing 7 may be made of metal for appearance reasons. The core 6 includes a connection sleeve 65 that is engaged on the end of the actuator rod 56. The connection sleeve 65 extends in the core 6 as far as a nozzle 63 that forms a dispenser orifice 60. The casing 7 is made with a hole 73 at the nozzle 63. As can be seen in FIG. 3, the core 6 forms annular reinforcement 61 in which a housing 62 is formed for receiving the nozzle 63. Below the annular reinforcement 61, the core 6 forms a skirt 64. Except for the configuration of the skirt 64, the pusher 6, 7 is of conventional design. The skirt 64 differs by the fact that it presents a horizontal cross-section of shape that is oblong or roughly rectangular. The skirt comprises two long parallel plane side faces 64*a* that are interconnected via two short curved faces 64*b*.

Returning to the fastener means 2, they also include a bushing 27 that extends upwards from the disk 25, substantially in alignment with the fastener ring 24. However, it is possible to envisage that the bushing 27 does not really extend in alignment with the bushing 24. The bushing 27 forms one or more cam paths 28 that can be seen more clearly in FIGS. 2 and 3. Each cam path 28 includes a top section 28*a* that is connected to a bottom section 28*b*. Thus, the two sections define two positions that are axially offset. By way of example, provision may be made for the offset between the two sections to be about one or a few tenths of a millimeter. Two or three cam paths 28 may be provided. Still with reference to FIG. 3, it should also be observed that the bushing 27 forms two notches 29*a* that are arranged in diametrically-opposite manner and that are separated by two ridges 29*b* that are higher axially. The crenelated profile formed by the notches 29*a* and the ridges 29*b* co-operates with the skirt 64 of the core 6 of the pusher to constitute a locking system for locking the pusher. When the skirt 64 is situated on the ridges 29*b*, it is impossible to move the pusher: the faces 64*a* or 64*b* rest on the ridges 29*b*. In contrast, when the plane long faces 64*a* of the skirt 64 are engaged in the notches 29*a*, the pusher is axially movable down and up. The pusher 6, 7 may thus be moved from the locked position to the unlocked position in one-fourth of a turn.

In the invention, the vent hole 26 formed in the disk 25 is closable by means of a flat annular gasket that acts as closure means 3. The gasket 3 is arranged on the disk 25. It can easily be understood that by pressing the gasket 3 against the disk 25, the vent hole 26 is closed. In contrast, when the pressure on the gasket 3 is relaxed, the vent hole 26 communicates with the outside by defining a vent passage. In order to urge the gasket 3 selectively against the vent hole 26, the present invention provides control means 4 that co-operate with the pusher, the fastener means, and the closure means. More precisely, the control means 4 co-operate with the skirt 64 of the core 6, with the cam paths 28 of the bushing 27, and with the gasket 3. To do this, the control means 4 include a crenelated ring 41 that forms two cutouts 46 for receiving the skirt 64 of the core 6: the two plane long faces 64*a* passing through the cutouts 46. The pusher and the control means are thus constrained to turn together, but may move axially relative to each other. The crenelated ring 41 also forms two cam lugs 42 in engagement in the two cam paths 28 of the bushing 27. The cam lugs 42 project radially outwards and are situated in diametrically-opposite manner below the two cutouts 46, as can be seen in FIG. 3. The control means 4 also include an annular flange 43 that extends just above the gasket 3 and that has a function of flattening it against the disk 25.

Figure 2:
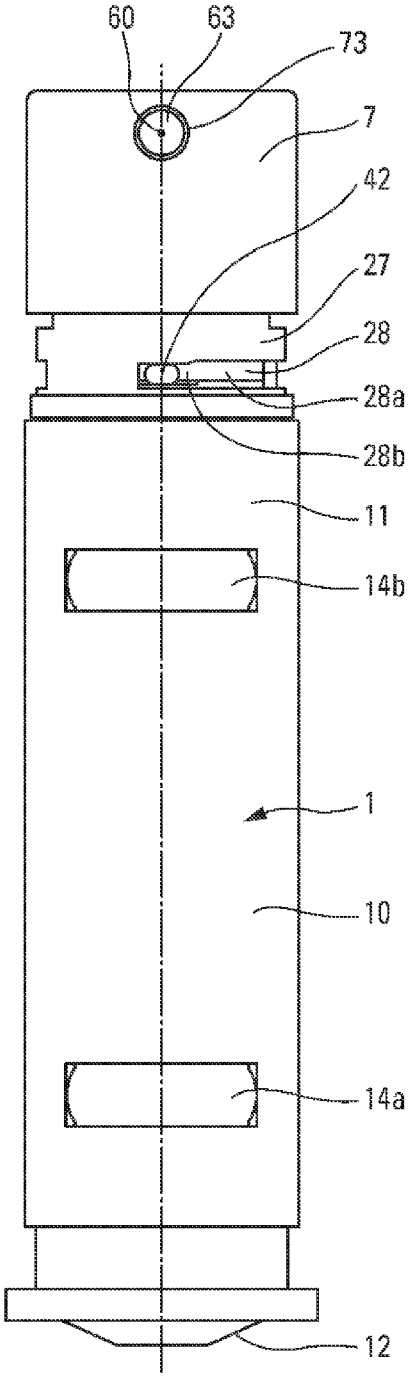
FIG. 2 is a side view of the FIG. 1 dispenser.

In order to flatten the gasket 3 against the disk 25, it suffices to turn the pusher about the axis X. The pusher turns the control means 4, given that the skirt 64 is held captive in the two cutouts 46. However, the control means 4 are not constrained to move with the pusher in the axial direction X. In other words, the skirt 64 may move axially inside the cutouts 46. Conversely, the control means 4 may move axially relative to the pusher. This enables the control means 4 to move axially over a very short distance by following the cam paths 28. The two lugs 42 of the control means 4 are engaged inside the cam paths 28 and follow the cam paths in such a manner as to pass from the top section 28*a* to the bottom section 28*b*, and vice versa. When the lugs 42 are situated in the bottom sections 28*b*, as shown in FIG. 2, the flange 43 presses hard on the gasket 3 and flattens it against the disk 25. The vent hole 26 is thus closed. In contrast, when the lugs 42 are situated at the top sections 28*a*, the disk 43 does not exert any pressure on the gasket 3, and the vent hole 26 may communicate with the outside by forming a vent passage.

In addition, as mentioned above, the dispenser incorporates a pusher locking system formed by the skirt 64 co-operating with the bushing 27. When the skirt 64 can penetrate into the notches 29*a*, the pusher is in its unlocked position. In the invention, the unlocked position corresponds to the lugs 42 being positioned in the top sections 28*a* of the cam paths 28. Conversely, when the skirt 64 is in abutment against the ridge 29*b*, the lugs 42 are situated in the bottom sections 28*b*. In other words, the locked position of the pusher corresponds to the closed configuration, and the unlocked position corresponds to the venting position. The vent passage is open in the unlocked position and is closed in the locked position. Functionally, it can be said that the closure means 3 are switchable between their closed condition, in which the vent passage is closed and the pusher is in its locked position, and their open condition in which the vent passage is open and the pusher is in its unlocked position.

Naturally, it is possible to implement the present invention without necessarily implementing a rotary locking system of the pusher. In addition, the gauge ring 19 that is guided by the tube 21 may be implemented independently of the closable vent system. The same applies for the guidance of the dip tube, which may be implemented independently. It is also possible to envisage incorporating the control means 4 in the pusher, such that the pusher comes into direct contact with the gasket 3 in the locked position and comes out of contact with the gasket 3 in the unlocked position.

The invention thus provides a refillable dispenser that incorporates a vent-passage closure system that is particularly simple to manipulate and/or fluid-level indicator means that are particularly advantageous.

The invention claimed is:

1. A fluid dispenser comprising:

a fluid reservoir defining a neck and a bottom wall provided with a filling valve;

a dispenser member, such as a pump, that is mounted on the reservoir so as to take the fluid, the dispenser member including a body and an actuator rod that is movable downwards and upwards along an axis X;

a pusher that is mounted on the actuator rod of the dispenser member in such a manner as to turn about the axis X of the rod;

a vent passage that puts the reservoir into communication with the outside;

closure means for selectively closing the vent passage; and control means for urging the closure means into a closed condition, in which they close the vent passage, from an open condition, in which they do not close the vent passage;

the dispenser being characterized in that the control means are turned by the pusher so as to switch the closure means between their open condition and their closed condition.

2. A dispenser according to claim 1, wherein the control means are in engagement with a cam path that defines two offset axial positions for moving the control means axially between the closed and open conditions.

3. A dispenser according to claim 2, wherein the cam path is formed by a bushing that is secured to the reservoir.

4. A device according to claim 1, including fastener means for fastening the dispenser member in the reservoir, the fastener means comprising a fastener ring in leaktight engagement in the neck of the reservoir, and reception means for receiving the body of the dispenser member, the fastener ring being connected to the reception means via an annular disk.

5. A device according to claim 3, wherein the bushing is formed by a fastener means in axial alignment with a fastener ring.

6. A device according to claim 4, wherein the vent passage comprises a vent hole (26) that is formed in the fastener means, advantageously at the annular disk.

7. A device according to claim 4, wherein the closure means comprise an annular gasket that is arranged on the annular disk in such a manner as to be able to be compressed between the control means and the fastener means.

8. A device according to claim 4, wherein the reception means comprise a tube in which the body of the dispenser member is interfitted in leaktight manner.

9. A device according to claim 8, wherein the tube extends into the proximity of the bottom wall of the reservoir, a gauge ring being engaged freely around the tube in such a manner as to float in the fluid of the reservoir so as to indicate the level of fluid in the reservoir.

10. A device according to claim 8, wherein the tube extends into the proximity of the bottom wall of the reservoir, the dispenser member being provided with a dip tube that extends into the reservoir, the tube surrounding the dip tube so as to guide it into the reservoir, in particular at the bottom of the reservoir.

11. A device according to claim 8, wherein the tube extends into the proximity of the bottom wall of the reservoir, the filling valve comprising a valve seat formed in the bottom wall of the reservoir and a valve member received in the reservoir and further comprising a closure pin for selectively coming into leaktight contact with the valve seat, the pin being connected to resilient drive elements, the tube pressing on the resilient elements so as to urge the pin against its seat.

12. A device according to claim 1, further including a locking system for locking the pusher, preventing it from moving axially in a locked position and allowing it to move axially in an actuation position, the pusher switching from one position to the other by turning about the axis X.

13. A device according to claim 5, comprising a locking system formed by the pusher and the bushing.

14. A device according to claim 4, wherein a bushing is formed by the fastener means in axial alignment with the fastener ring.

15. A device according to claim 12, wherein the locking system is formed by the pusher and the bushing.

* * * * *